United States Patent [19]

Kondoh

[11] Patent Number: 5,065,806

[45] Date of Patent: Nov. 19, 1991

[54] PANEL SHUTTER ASSEMBLY

[75] Inventor: Kohichi Kondoh, Tokyo, Japan

[73] Assignee: Bunka Shutter Co., Ltd., Tokyo, Japan

[21] Appl. No.: 645,842

[22] Filed: Jan. 25, 1991

[30] Foreign Application Priority Data

Jun. 5, 1990 [JP] Japan ..... 1-146930

[51] Int. Cl.[5] ..... E06B 9/26

[52] U.S. Cl. ..... 160/36

[58] Field of Search ..... 160/36, 32, 33, 35, 160/188, 201, 37, 220

[56] References Cited

U.S. PATENT DOCUMENTS

| | | | |
|---|---|---|---|
| 2,897,886 | 8/1959 | Pistelli | 160/33 |
| 4,139,042 | 2/1979 | Watanabe et al. | 160/36 |
| 4,595,043 | 6/1986 | Nozawa et al. | 160/36 |
| 4,610,289 | 9/1986 | Sugihara | 160/35 |
| 4,662,420 | 5/1987 | Hirao | 160/32 |
| 4,807,685 | 2/1989 | Losch | 160/36 |
| 4,838,331 | 6/1989 | Kasai | 160/36 |

*Primary Examiner*—David M. Purol

*Attorney, Agent, or Firm*—Rothwell, Figg, Ernst & Kurz

[57] ABSTRACT

A panel shutter assembly includes a plurality of shutter panels supported one after another between a pair of chains. Each panel is suspended from a pair of pins carried by the two chains, respectively, and each chain, therefore, carries a plurality of pins. Each chain includes a plurality of spaced apart link attachments each having a longitudinally extending pin guide slot through which one of the pins extends slidably along the slot. The chains engage a pair of sprockets, respectively. A pair of arms are supported respectively on the shafts on which the sprockets are rotatably supported. The arms are rotatable with the sprockets and extend radially of the sprockets to project beyond the outer peripheries thereof to engage each pair of pins that have approached the sprockets.

5 Claims, 20 Drawing Sheets

PANEL SHUTTER ASSEMBLY

BACKGROUND OF THE INVENTION

1. Field of the Invention

This invention relates to a panel shutter assembly which is used for closing and opening an entry to a building, a window, etc.

2. Description of the Prior Art

There is known a panel shutter assembly which comprises a plurality of shutter panels suspended from chains meshing with sprockets for raising and lowering the panels to open and close a shutter opening automatically. This type of shutter has been drawing much attention as having outstanding fireproofness.

The known panel shutter assembly is constructed as shown by way of example in FIGS. 16 to 18. It includes a pair of upstanding guide rails 1 provided along the two vertical edges, respectively, of a shutter opening as defined by an entry to a building, or a window, as shown in FIG. 16. Each guide rail 1 comprises a channel-shaped member defining a panel guide groove and the panel guide grooves of the two guide rails 1 face each other. A panel housing 2 is mounted above the guide rails 1.

The panel housing 2 has a bottom opening located above the guide rails 1. The housing 2 contains a pair of panel driving sprockets 3 located above the guide rails 1, respectively, and near the top of the housing 2, and a pair of panel supporting rails 4 lying in parallel to each other and each having a front end situated near the crest of one of the sprockets 3, extending away from it, and gradually inclined downwardly toward its rear end, as shown in FIG. 17.

A pair of chains 5 mesh with the sprockets 3, respectively, and are movable in the guide rails 1, respectively, in the housing 2 and about the sprockets 3, respectively, to the panel supporting rails 4, respectively. The chains 5 are of the usual construction and are slidably fitted in the guide rails 1, respectively. A plurality of vertically adjoining shutter panels 6 and 7 are suspended from the chains 5 which support each panel at the top corners thereof. Each chain 5 has a plurality of long pins P each serving also as a link pin extending through a link joint and each panel 6 or 7 is rotatably suspended from a pair of long pins P connected to its top corners, respectively. Each pin P carries a guide roller R which can be transferred onto one of the panel supporting rails 4 and roll on it when each panel is withdrawn for suspension from the rails 4, as will hereinafter be described in further detail.

Each panel 6 or 7 is constructed as shown in FIG. 17. Panels as shown in FIG. 19 are also known.

Referring first to FIG. 17, each panel 6 or 7 has a projection 8 extending along its top edge and a recess 9 extending along its bottom edge. The projection 8 of one panel 7 is adapted for fitting in the recess 9 of another panel 6, so that no clearance may be formed between any two adjoining panels 6 and 7 when the shutter is in its fully closed position in which all the panels 6 and 7 stay in a vertically adjoining relation to one another between the guide rails 1.

When the shutter is opened, the panels are raised into the housing 2, and moved horizontally past the sprockets 3 to be suspended from the panel supporting rails 4 one after another. If a lower panel 7 has its projection 8 remaining fitted in the recess 9 of an upper panel 6 as shown in FIG. 18, however, the upper panel 6 cannot be moved horizontally in the housing 2. Therefore, every two vertically adjoining panels 6 and 7 are so supported on the chains 5 as to have a gap L therebetween, so that the projection 8 of the lower panel 7 may be kept disengaged from the recess 9 of the upper panel 6 and thereby allow the upper panel 6 in the housing 6 to be horizontally moved toward the panel supporting rails 4, as shown in FIG. 17.

Referring now to FIG. 19, each panel 6 or 7 has a projection 8 extending along its bottom edge and a recess 9 extending along its top edge, as opposed to each panel 6 or 7 shown in FIG. 17. The recess 9 of each panel is defined by an overlapping extension 9*a* rising from the top of the panel on its front side and an overlapping extension 8*a* depends from the bottom of each panel on its rear side, so that when two panels 6 and 7 are joined, the projection 8 of the upper panel 6 may stay between its overlapping extension 8*a* and the overlapping extension 9*a* of the lower panel 7, as shown in FIG. 19. The overlapping extensions 8*a* and 9*a* serve to close any gap that is required between every two vertically adjoining panels to allow the upper panel 6 in the housing 2 to be moved horizontally toward the panel supporting rails 4.

Referring to the closing of the shutter, the sprockets 3 are rotated counterclockwise, as viewed in FIG. 17 or 19, to move the chains 5 in the same direction. As the chains 5 are moved, the panels 6 and 7 are moved along the panel supporting rails 4 toward the sprockets 3. As the sprockets 3 are further rotated, the panels 6 and 7 are moved past the sprockets 3 and lowered along the guide rails 1 one after another.

No engagement between the projection 8 and the recess 9 occurs between any two vertically adjoining panels until the lowermost panel reaches the ground, whether the panels may be of the type shown in FIGS. 17 or 19. If the lowermost panel reaches the ground, the engagement between the projection 8 and the recess 9 occurs between the lowermost panel and another panel following it immediately, whereby the gap between the two adjoining panels 6 and 7 is closed. As the panels are lowered one after another, such engagement occurs to one pair of vertically adjoining panels after another until the gap between every two vertically adjoining panels is closed when all the panels 6 and 7 have been lowered between the guide rails 1 to bring the shutter to its fully closed position.

When it is desired that the shutter be opened, the sprockets 3 are rotated in the opposite direction to cause the chains 5 to raise the panels 6 and 7 one after another. As the panels are raised into the housing 2 one after another, the disengagement between the projection 8 and the recess 9 occurs to one pair of vertically adjoining panels after another. Therefore, each panel 6 or 7 having its top edge raised to the area between the sprockets 3 can smoothly be moved horizontally past the sprockets 3 to the panel supporting rails 4. As each panel is moved horizontally, the guide rollers R ride on the panel supporting rails 4, so that all the panels 6 and 7 are eventually suspended from the rails 4 in parallel to one another.

It is, however, necessary that the gap L be present between each pair of vertically adjoining panels 6 and 7 including the upper panel 6 that has been raised into the housing 2, to enable the horizontal movement of the upper panel 6 toward the panel supporting rails 4 when the shutter is opened, as hereinbefore stated. The presence of the gap L is likely to present a number of problems, as will hereinafter be pointed out.

Although the gap L shown in FIG. 17 is closed between one pair of vertically adjoining panels 6 and 7 after another as the panels are lowered along the guide rails 1 one after another when the shutter is closed, the gap L remains open between any two vertically adjoining panels until the lower thereof rests on the ground or another panel. Therefore, it is likely that a finger or fingers may get caught in the gap L and hurt, or that anything else may be trapped in the gap L.

If the panels 6 and 7 are of the type as shown in FIG. 19, the gap L between every two vertically adjoining panels remains closed by the overlapping extensions 8*a* and 9*a*, and it is, therefore, unlikely that a finger, or anything else may be caught in the gap L. The overlapping extensions 8*a* and 9*a*, however, make each panel more complicated in construction and therefore more expensive. Moreover, they add to the height of each panel and thereby the height of the panel housing 2, too. This brings about a great limitation to the place in which the shutter including the panels of the type as shown in FIG. 19 can be installed.

SUMMARY OF THE INVENTION

It is a principal object of this invention to provide a panel shutter assembly in which no gap is formed between any two vertically adjoining shutter panels lowered between guide rails when a shutter is closed, while a gap is formed between each pair of vertically adjoining panels to enable the upper thereof to be smoothly moved in a panel housing to the position in which it stays when the shutter is opened, and in which each panel is simple and compact in construction and the panel housing is, therefore, compact, too.

It is another object of this invention to provide a highly reliable panel shutter assembly in which the chains on which shutter panels are supported can be prevented from being undesirably disengaged from the teeth on chain-driving sprockets when the panels are raised, while the long pins by which the panels are supported on the chains can be prevented from being undesirably engaged with the teeth on the sprockets when the panels are lowered, so that the panels may be smoothly raised and lowered.

The principal object of this invention as hereinabove set forth is attained by a panel shutter assembly which includes a pair of chains supporting a plurality of shutter panels therebetween and each having a plurality of elongated link attachments each having a longitudinally extending pin guide slot, the panels being supported by a plurality of long pins each connected to each panel on one side thereof and extending through the slot of one of the link attachments on one of the chains slidably along the slot; and a pair of arms each connected to the shaft on which one of a pair of sprockets engaging the chains, respectively, to move them and thereby the panels is rotatably supported, each arm extending radially of one of the sprockets and having a free end portion located beyond the periphery of the sprocket, each arm being rotatable with the sprocket to have its free end portion engage one of the long pins.

Each chain comprises a plurality of chain blocks each formed by a plurality of links connected flexibly to one another, and each link attachment as hereinabove described is used for connecting a pair of chain blocks flexibly. Each panel is supported by a pair of long pins each connected to the panel on one side thereof and extending through the slot of one of the link attachments on one of the chains slidably along the slot.

The panel shutter assembly may further include a plurality of cam mechanisms each associated with one of the arms to minimize the radius of rotation of the arm in the region where the long pin is moved from the periphery of the sprocket to a panel supporting rail.

The other object of this invention as hereinabove set forth is attained by a panel shutter assembly which includes a pair of chains supporting a plurality of shutter panels one after another therebetween and engaging a pair of sprockets, respectively, which are rotatable to move the chains and thereby the panels, each chain comprising a plurality of links and a plurality of link attachments which are greater in length than the links, and at which the panels are supported on one side thereof by the chain, each link attachment having a longitudinally extending pin guide slot, the panels being supported by a plurality of long pins each connected to one of the panels on one side thereof adjacent to the top edge thereof and extending through the slot of one of the link attachments on one of the chains slidably along the slot; and a pair of arms each connected slidably to the shaft on which one of the sprockets is rotatably supported, each arm extending radially of one of the sprockets and having a free end portion located beyond the periphery of the sprocket, each arm being rotatable with the sprocket to have its free end portion cross the slot of one of the link attachments and engage the long pin extending therethrough, the free end portion of each arm terminating in a stop surface which is engageable with the long pin extending through the slot of one of the link attachments to hold it at the rear end of the slot when the sprockets are rotated to move the panels to the closed position of the shutter.

The free end portion of each arm may further have an engaging edge which is engageable with one of the long pins to displace it radially outwardly of the corresponding sprocket and thereby disengage it from the teeth of the sprocket when the sprockets are rotated to move the panels to the open position of the shutter, and each link attachment may have a recess formed in the periphery of its slot for holding the radially outwardly displaced pin therein.

If the sprockets are rotated to move the panels from the closed position of the shutter in which all the panels stay between the guide rails, to its open position, the chains are raised to raise the panels one after another along the guide rails. When the link attachments of the chains through which the long pins supporting one of the panels extend have arrived in the vicinity of the sprockets, the arms rotating with the sprockets engage the long pins, respectively, and push them up along the slots of those link attachments, so that the panel suspended from those long pins is raised at a higher speed than any other panel staying at a lower level of height is. This is due to the fact that the free end portions of the arms project beyond the peripheries of the sprockets and have, therefore, a peripheral velocity which is higher than that of the sprockets. As the panel suspended from the long pins engaged by the arms is raised at a higher speed than the lower panel, a gap is formed between those panels and thereby enables the upper panel to be smoothly moved horizontally to the position in which it has to stay when the shutter is opened. This gap is formed only between the panel which has been raised into a panel housing, and the immediately lower panel, and no such gap is formed between any two adjoining panels staying between the guide rails. Therefore, there is no possibility of a finger, or anything else being caught between any two adjoining panels staying between the guide rails. The panels are not required to have any overlapping extension of the nature which has hereinbefore been described with reference to the prior art. The panels in the panel shutter assembly of this invention are, therefore, simple and compact in construction and call only for a compact panel housing.

The panel shutter assembly of this invention is particularly characterized by the chains, and more specifically, by the link attachments having the pin guide slots in which the long pins supporting the panels are slidingly movable by the arms. The sliding movement of the long pins in the slots enables the formation of a gap only between the upper panel which has been raised into the panel housing, and the immediately lower panel to allow for the horizontal movement of the upper panel away from the lower panel, while no such gap is formed between any two adjoining panels staying between the guide rails.

The cam mechanisms minimize the radius of rotation of the arms in the region where each pair of long pins connecting one of the panels to the chains are moved away from the sprockets to the panel supporting rails, and ensure the smooth disengagement of the arms from the long pins and thereby the smooth transfer of the panel to the panel supporting rails.

When the sprockets are rotated to lower the panels, the stop surfaces of the arms engage the long pins arriving at the sprockets and thereby hold them at the rear ends of the slots of the link attachments through which they extend. The stop surfaces prevent the undesirable movement of the long pins toward the front ends of the slots and thereby any improper engagement of the long pins with the teeth on the sprockets.

When the sprockets are rotated to raise the panels, the engaging edges of the arms engage the long pins arriving at the sprockets and cause them to be displaced radially outwardly of the sprockets into the recesses which are contiguous to the slots of the link attachments. This ensures that the link pins at both ends of the link attachments, and therefore the chains, be held in proper engagement with the teeth on the sprockets.

These and other objects, features and advantages of this invention will become more apparent from the following description and the accompanying drawings. It is, however, to be understood that the drawings are merely illustrative and are not intended for limiting the scope of this invention.

DETAILED DESCRIPTION OF THE PREFERRED EMBODIMENTS

Figure 1:
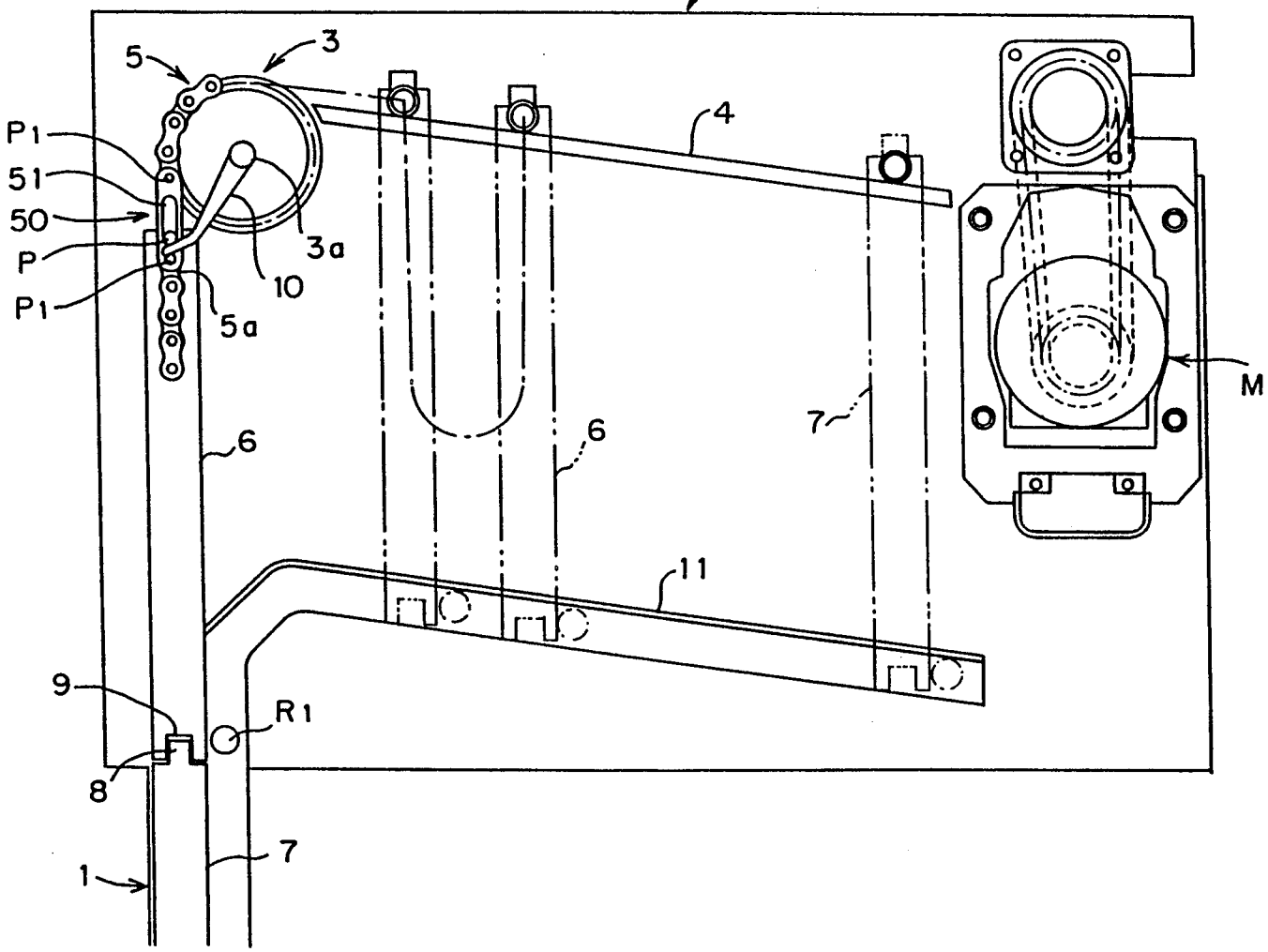
FIG. 1 is a fragmentary and schematic side elevational view, partly in section, of a panel shutter assembly embodying this invention.
Figure 3:
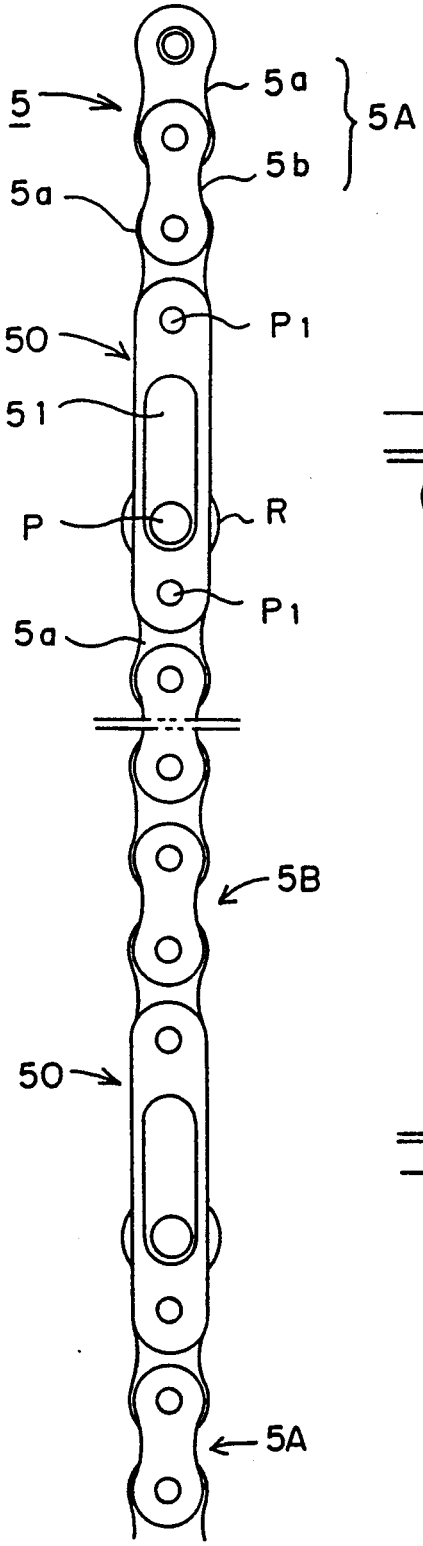
FIG. 3 is a side elevational view of the chain shown in FIG. 2.

The invention will now be described in detail with reference to the drawings showing a number of preferred embodiments thereof. Like numerals are used to indicate like parts throughout all of the drawing figures including FIGS. 16 to 19 showing the prior art which has already been described, so that no repeated description of any of those parts may be required.

Reference is first made to FIGS. 1 to 5 showing the panel shutter assembly according to one embodiment of this invention. The assembly includes a plurality of shutter panels supported between a pair of chains 5, though only two panels 6 and 7 are shown. Each chain 5 comprises a plurality of links including a plurality of elongated link attachments 50 where the panels are supported between the chains 5. Each link attachment 50 is greater in length than any other link 5*a* of the ordinary type and has a pair of ends each connected rotatably to a link 5*a* by a line pin P1. Each link attachment 50 has a longitudinally extending pin guide slot 51.

Figure 2:
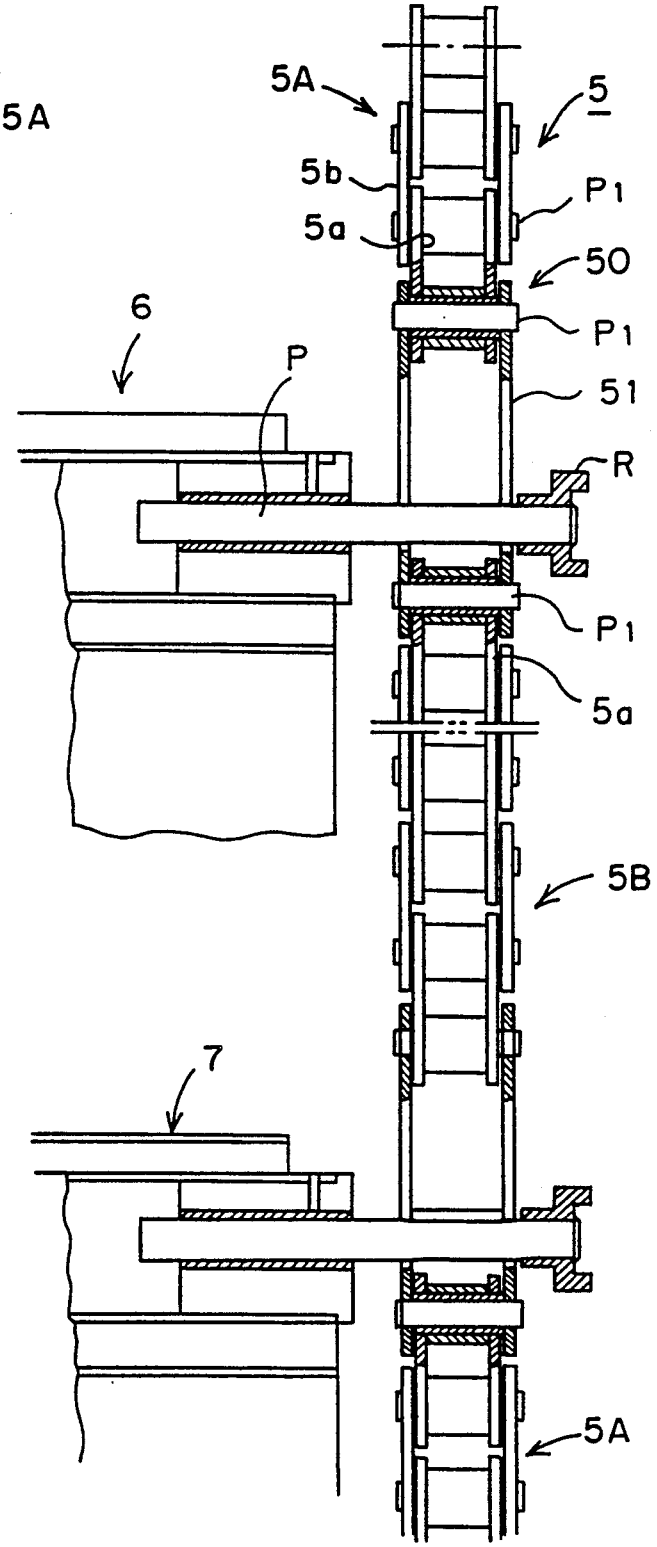
FIG. 2 is an enlarged front elevational view, partly in section, of a chain and panels supported thereon.

Each panel 6 or 7 is supported between the chains 5 by a pair of long pins P from which it is suspended, and each of which is connected to one side of the panel adjacent to its top edge, as shown in FIG. 2. Each long pin P extends through the slot 51 of one of the link attachments to its top edge, as shown in FIG. 2. Each long pin P extends through the slot 51 of one of the link attachments 50 on one of the chains 5 and is slidable along the slot 51. Each panel 6 or 7 is of the same construction as each panel shown in FIG. 17, and has a projection 8 extending along its top edge and a recess 9 extending along its bottom edge.

The panels are so positioned relative to one another between the chains 5 that, when they stay one above another between a pair of guide rails 1, the projection 8 of one panel 7 may be fitted in the recess 9 of another panel 6, while the long pins P from which each panel is suspended are held at the lower ends of the slots 51 of the corresponding link attachments 50, respectively, by the weight of the panel, as shown in FIG. 1.

Figure 4:
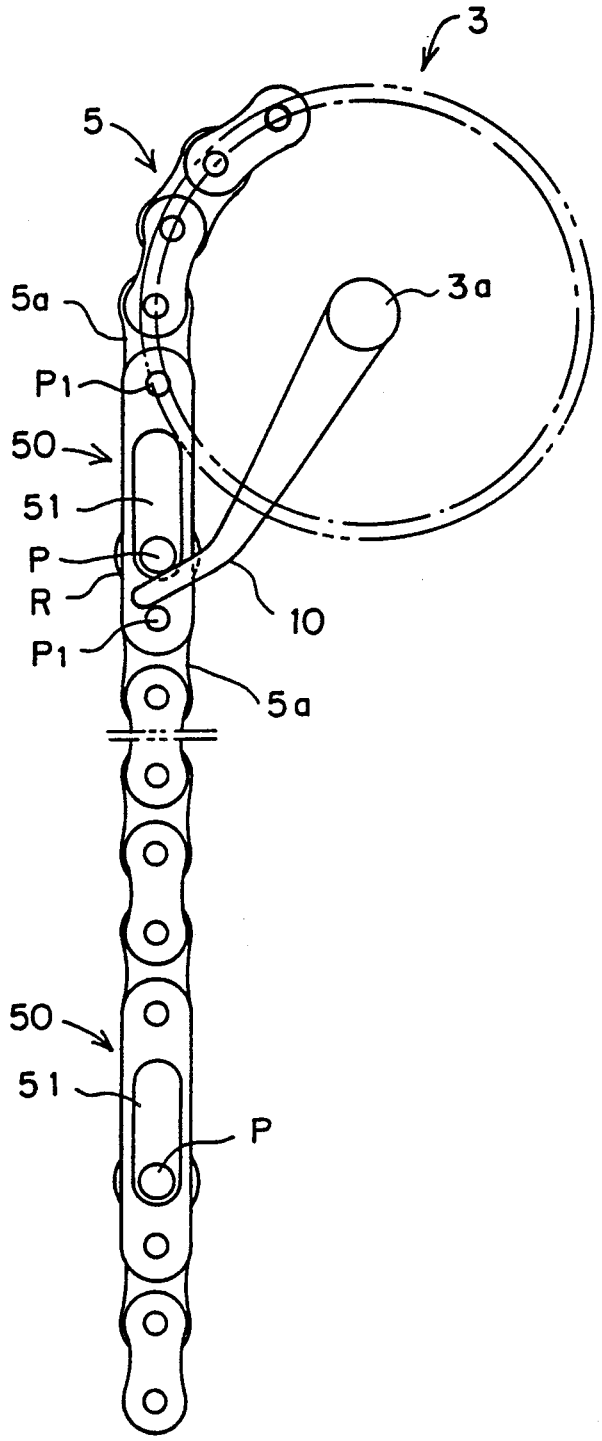
FIG. 4 is an enlarged side elevational view of the sprocket and chain shown in FIG. 1.

The assembly further includes a pair of arms 10 which are each connected at its base end to the shaft 3a on which one of a pair of sprockets 3 engaging the chains 5, respectively, is rotatably supported, and which are rotatable with the sprockets 3. Each arm 10 extends radially of the corresponding sprocket 3 and has a free end portion which projects beyond the outer periphery of the sprocket 3 and is engageable with any long pin P in the vicinity of the sprocket 3, as shown in FIG. 1 or 4. As the arms 10 project beyond the outer peripheries of the sprockets 3 and are rotatable therewith, they have at the free ends thereof a peripheral velocity which is higher than that of the sprockets 3.

The sprockets 3 are rotatable in either direction, and is rotated in one direction to open the shutter and in the other direction to close it. If the sprockets 3 are rotated in one direction when the shutter is in its closed position in which the panels 6 and 7 stay between the guide rails 1, the chains 5 are raised to raise the panels 6 and 7 one after another along the guide rails 1 into a panel housing 2.

Figure 5:
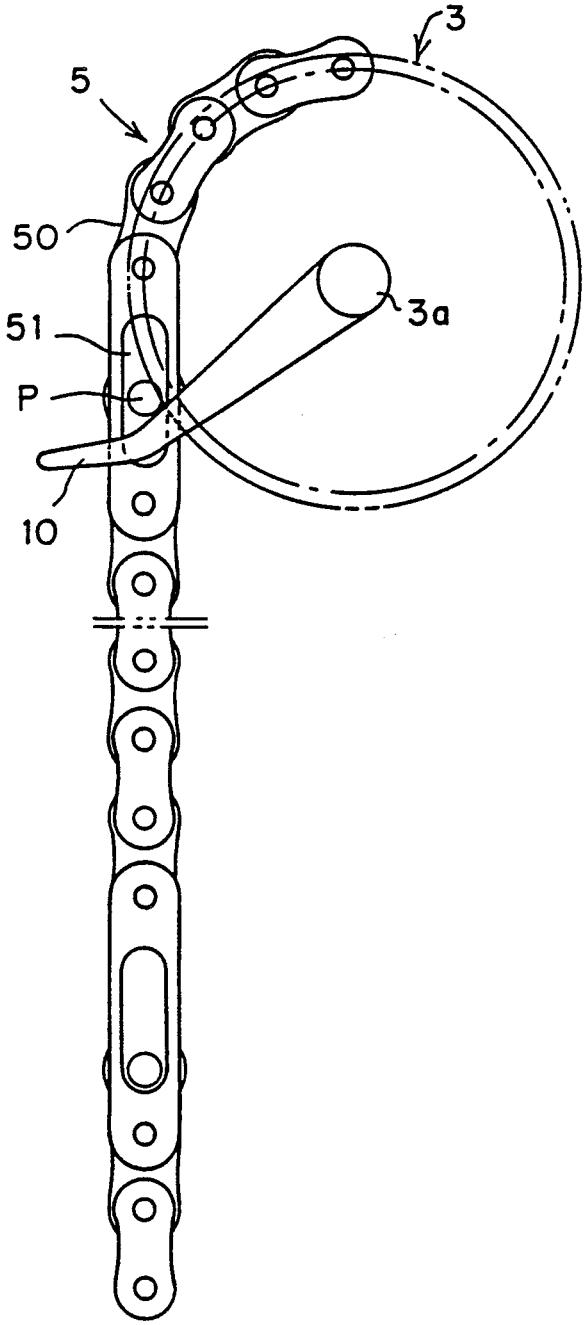
FIG. 5 is a view similar to FIG. 4, but showing the chain in a different position from that shown in FIG. 4.

As the chains 5 are raised, the link attachments 50 between which one panel 6 is supported approach the sprockets 3, and the free end portions of the arms 10 engage the long pins P extending through the slots 51 of the link attachments 50 at the lower ends thereof, as shown in FIG. 1. The arms 10 rotating with the sprockets 3 push up the long pins P along the slots 51, as shown in FIG. 5, since the free end portions of the arms 10 projecting beyond the outer peripheries of the sprockets 3 rotate at a speed which is higher than the peripheral velocity of the sprockets 3 and therefore the speed at which the chains 5 are raised by the sprockets 3. The panel 6 suspended from the long pins P which have been pushed up (hereinafter referred to as upper panel) is raised faster than another panel 7 following it (hereinafter referred to as lower panel) is, and the projection 8 of the lower panel 7 is disengaged from the recess 9 of the upper panel 6, so that the upper panel 6 is smoothly moved past the sprockets 3 toward the panel supporting rails 4, and suspended from the rails 4 by means of the rollers R carried at the outer ends of the long pins P, respectively.

The operation of the assembly as hereinabove described is continued until all the panels are brought to the open-. position of the shutter in which they are suspended from the panel supporting rails 4 in parallel to one another with the chains 5 folded between every two adjoining panels.

If the sprockets 3 are rotated in the opposite direction when the shutter is in its open, position, the chains 5 are lowered about the sprockets 3 to pull the panels toward the sprockets 3 one after another, so that the panels are moved past the sprockets 3 and lowered to the space between the guide rails 1 one after another, while the free end portions of the arms 10 rotating with the sprockets 3 follow the long pins P which are moved about the sprockets 3 one pair after another. As each pair of link attachments 50 are moved about the sprockets 3 to their upright positions, the long pins P extending therethrough drop to the lower ends of the slots 51, respectively, as the weight of the panel suspended from the pins P forces them down. As a result, the projection 8 of one panel 7 staying between the guide rails 1 is fitted in the recess 9 of another panel 6, as shown in FIG. 1.

Attention is now drawn to FIGS. 6 to 11 showing the panel shutter assembly according to another embodiment of this invention. This assembly is characterized by including a pair of arms 10 each supported rotatably and slidably on the shaft 3a on which one of the sprockets 3 is rotatably supported, and a cam mechanism 11 associated with each arm 10. Each arm 10 is rotatable with the sprocket 3 and is slidable along its own length.

Figure 9:
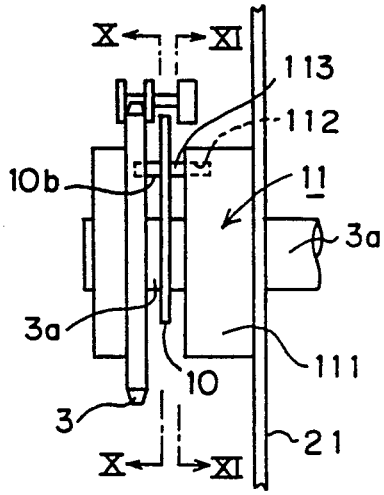
FIG. 9 is an enlarged view taken along the line IX—IX of FIG. 6.

The cam mechanism 11 includes a cam block 111 secured to the inner surface of a sidewall 21 of a panel housing 2 and surrounding the shaft 3a, as shown in FIG. 9. The arm 10 is located between the sprocket 3 and the cam block 111 and has a long slot 10a formed in its base end portion. The shaft 3a extends through the slot 10a, but the arm 10 is not secured to the shaft 3a. The arm 10 has a free end portion projecting beyond the outer periphery of the sprocket 3. The arm 10 is provided in its middle portion with a guide pin 10b projecting from one surface thereof facing the sprocket 3. The sprocket 3 is provided in its surface facing the arm 10 with a radially extending slot 3b in which the guide pin 10b is slidably fitted. Therefore, the rotation of the sprocket 3 is transmitted to the arm 10 through the guide pin 10b and the arm 10 is rotatable with the sprocket 3. The slots 3b and 10a permit the arm 10 to move radially outwardly or inwardly of the sprocket 3 as shown by an arrow a or b, respectively, in FIG. 10. This movement ensures the engagement of the free end portion of the arm 10 with a long pin P on a chain 5, or its disengagement from the pin P, as the case may be.

Figure 6:
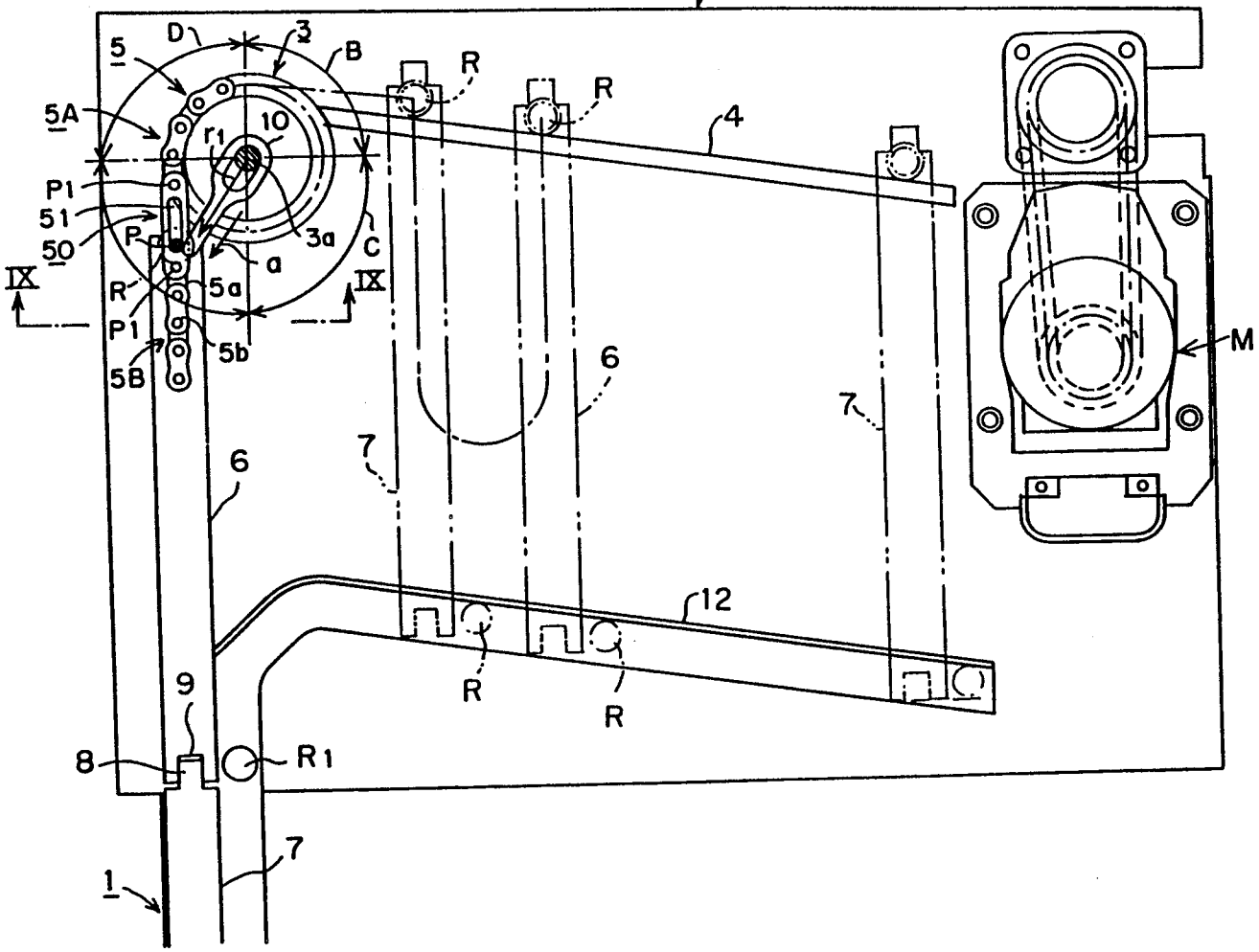
FIG. 6 is a fragmentary and schematic side elevational view, partly in section, of a panel shutter assembly according to another embodiment of this invention.
Figure 7:
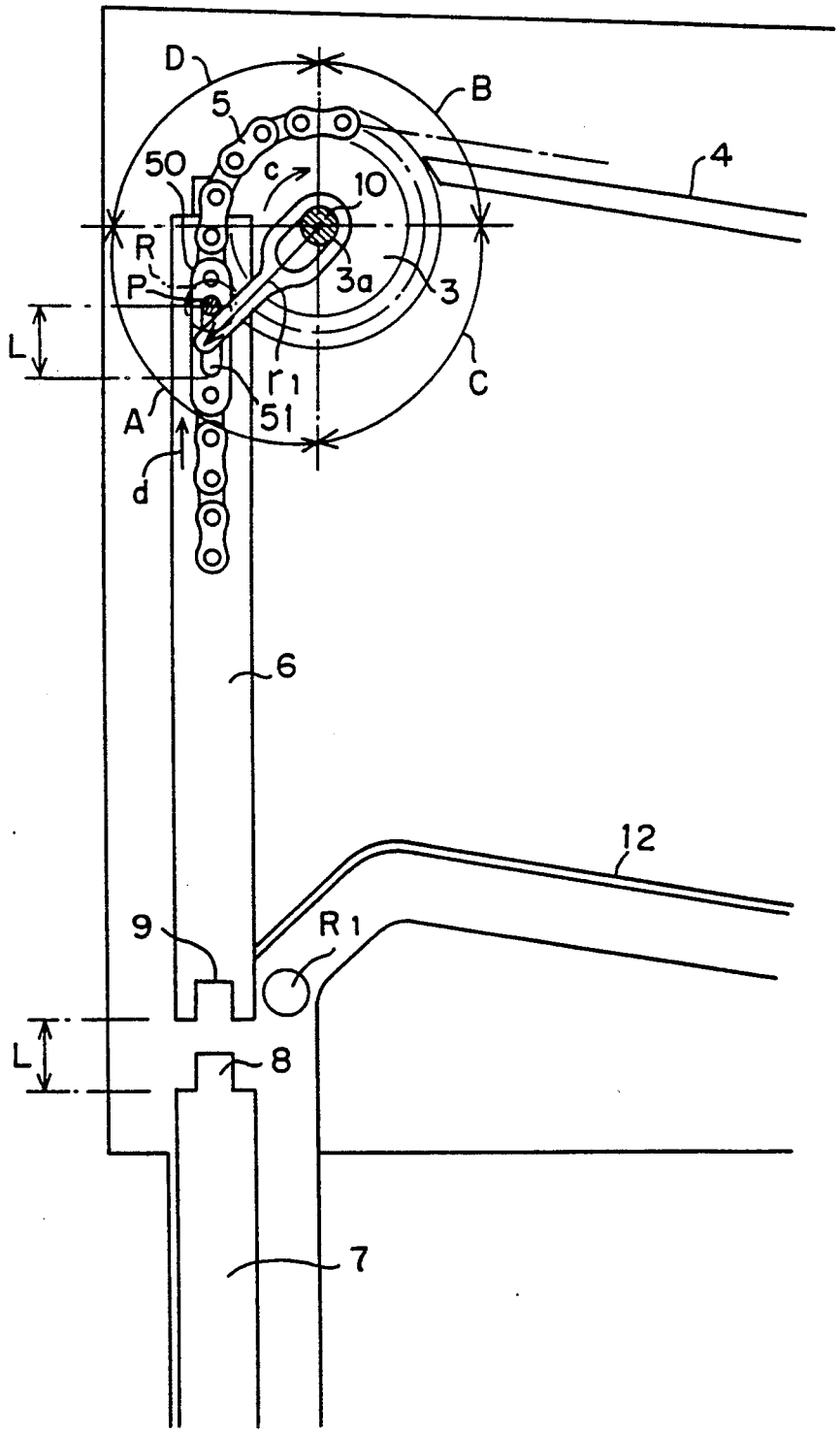
FIGS. 7 and 8 are a couple of views illustrating the operation of the device shown in FIG. 6.
Figure 8:
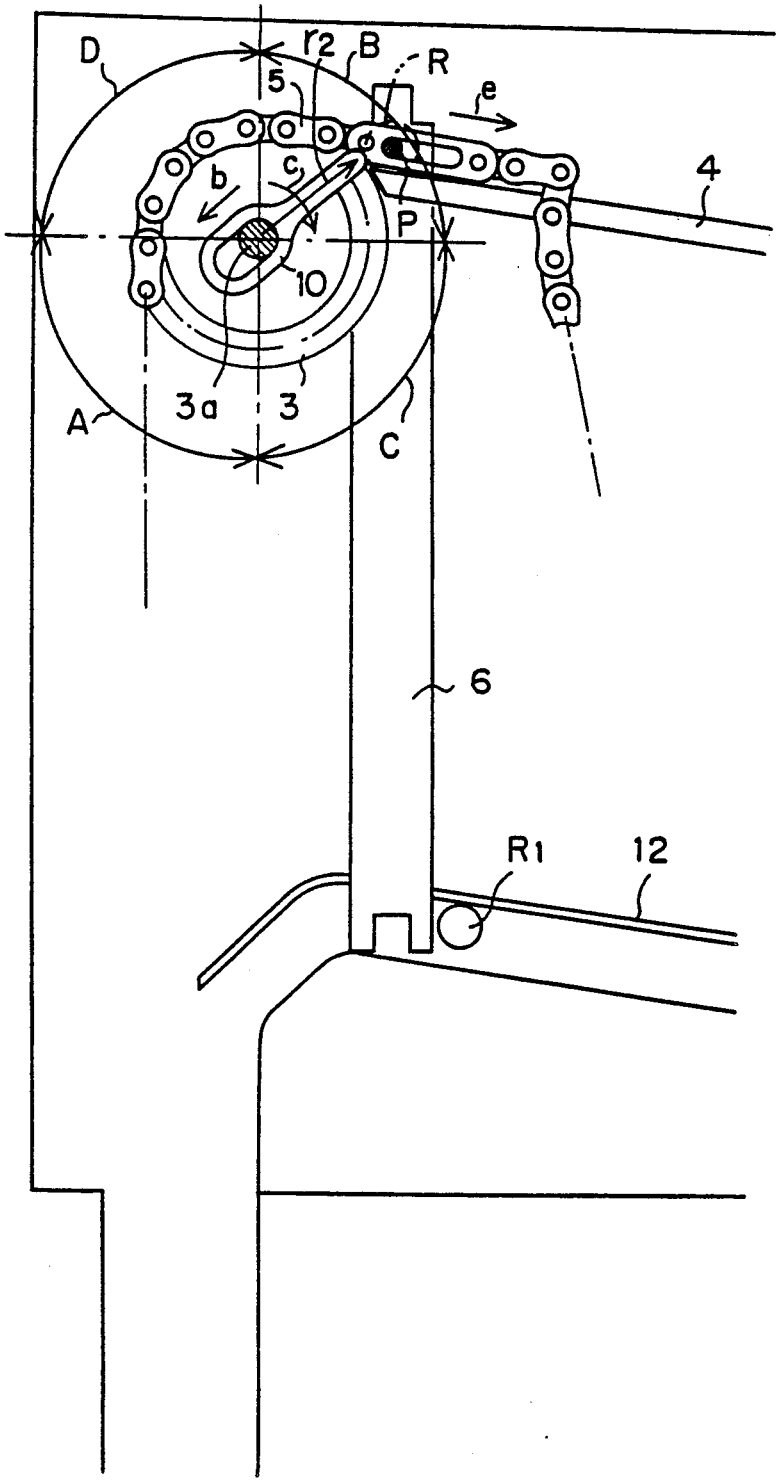
Figure 11:
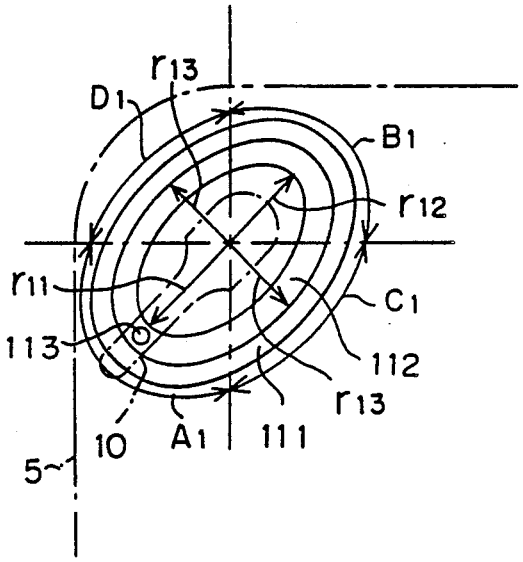
FIG. 11 is a sectional view taken along the line XI—XI of FIG. 9.

The cam mechanism 11 comprises the cam block 111 having an endless cam groove 112 formed in its surface facing the arm 10, and a cam follower defined by a guide pin 113 secured to the arm 10 on its surface facing the cam block 111, and fitted slidably in the cam groove 112, as shown in FIGS. 9 and 11. As the arm 10 is rotated with the sprocket 3, the guide pin 113 moving along the cam groove 112 guides the arm 10 for movement radially outwardly or inwardly of the sprocket 3 to cause its free end to project or retract relative to the outer periphery of the sprocket 3. The cam groove 112 has an oval shape and is divided into four portions $A_1$ to $D_1$ by its radius, as shown in FIG. 11. The cam groove 112 has its maximum radius $r_{11}$ in its portion $A_1$, its minimum radius $r_{12}$ in its portion $B_1$, and a continually varying radius $r_{13}$ in each of two intermediate portions $C_1$ and $D_1$. The free end of the rotating arm 10 follows a path divided into four sections A to D, as shown in FIGS. 6 to 8, which correspond to the four portions $A_1$ to $D_1$ of the cam groove 112. The arm 10 pushes up a long pin P when it is in the section A, and allows it to be transferred from the sprocket 3 to the panel supporting rail 4, while each of the sections C and D exists between the sections A and B. When it is in the section A, the arm 10 is advanced to the greatest extent in the direction of the arrow a radially outwardly of the sprocket 3 and has its maximum radius $r_1$ of rotation, as shown in FIG. 6, and when it is in the section B, it is retracted to the greatest extent in the direction of the arrow b and has its minimum radius $r_2$ of rotation, as shown in FIG. 8, while its radius of rotation continuously varies in the direction of the arrow a or b in the intermediate section C or D, respectively.

When the shutter is in its closed position in which the panels stay between the guide rails 1, the weight of each panel holds the long pins P at the lower ends of the pin guide slots 51 and the projection 8 of one panel 7 stays within the recess 9 of another panel 6, so that the shutter may be kept in its totally closed position.

If the sprockets 3 are rotated in one direction, as shown by an arrow c in FIG. 7, to raise the panels, the chains 5 are raised to raise the panels 6 and 7 one after another in the direction of an arrow d into the panel housing 2. As the chains 5 are raised, the link attachments 50 between which one panel 6 is supported rise in the direction of the arrow d into the section A with the long pins P from which the panel 6 is suspended, and the free end portions of the arms 10 rotating in the direction of the arrow c with the sprockets 3 and having the maximum radius $r_1$ of rotation engage the long pins P staying at the lower ends of the slots 51. The arms 10 push up the long pins P by a height L along the slots 51, as shown in FIG. 7, since the free end portions of the arms 10 projecting beyond the outer peripheries of the sprockets 3 rotate at a speed which is higher than the peripheral velocity of the sprockets 3 and therefore than the speed at which the chains 5 are raised by the sprockets 3. This means that the upper panel 6 is raised faster than the lower panel 7. As a result, the projection 8 of the lower panel 7 is disengaged from the recess 9 of the upper panel 6, and a gap L is formed between the two panels and 7. This gap L enables the upper panel 6 to be smoothly moved past the sprockets 3 toward the panel supporting rails 4. As the arms 10 leave the section A and continue rotating in the direction of the arrow c through the next section D, they gradually decrease their radius of rotation.

The arms 10 are, then, retracted to have their minimum radius $r_2$ of rotation in the section B in which the long pins P from which the panel 6 is suspended are transferred in the direction of an arrow e from the sprockets 3 to the panel supporting rails 4 on which the guide rollers R carried on the pins P ride, as shown in FIG. 8. As the arms 10 continue rotating in the direction of the arrow c, they are easily disengaged from the long pins P moving in the direction of the arrow e, and there is no possibility of the pins P being caught between the arms 10 and the panel supporting rails 4.

As the arms 10 leave the section B and continue rotating in the direction of the arrow c through the next section C, they gradually increase their radius of rotation, and when they have reached the section A, they recover their maximum radius $r_1$ of rotation.

The operation of the assembly as hereinabove described is continued until all the panels are brought to the open position of the shutter in which they are suspended from the panel supporting rails 4 in parallel to one another by means of the guide rollers R resting on the rails 4 with the chains 5 folded between every two adjoining panels.

If the sprockets 3 are rotated in the opposite direction when the shutter is in its open position, the chains 5 are lowered about the sprockets 3 to pull the panels toward the sprockets 3 one after another, so that the panels are moved past the sprockets 3 and lowered to the space between the guide rails 1 one after another, while the free end portions of the arms 10 rotating with the sprockets 3 follow the long pins P which are moved past the sprockets 3 one pair after another. As each pair of link attachments 50 are moved about the sprockets 3 to their upright positions, the weight of the panel suspended from the long pins P extending therethrough causes the pins P to drop to the lower ends of the slots 51, respectively. As a result, the projection 8 of one panel staying between the guide rails 1 is fitted in the recess 9 of another panel.

Figure 10:
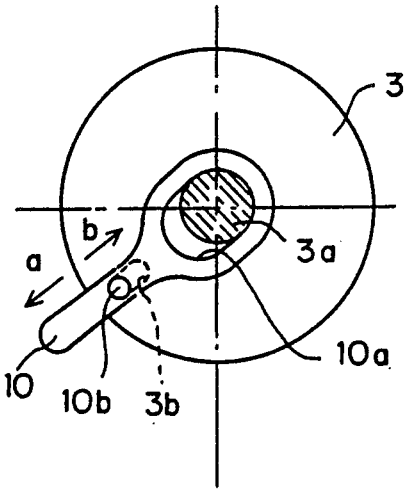
FIG. 10 is a sectional view taken along the line X—X of FIG. 9.
Figure 12:
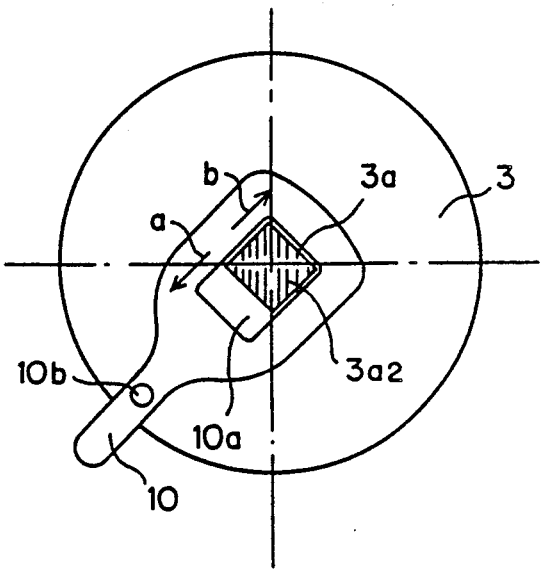
FIG. 12 is a view showing a modified form of the device shown in FIG. 10.

A modified form of the device shown in FIG. 10 is shown in FIG. 12. In the modified device, each shaft **3*a* includes a portion $3a_2$ having a rectangular cross section and each arm 10 has a rectangular slot 10*a* which is fitted about the rectangular portion $3a_2$ of one of the shafts 3*a* slidably. The arm 10 is rotatable with the sprocket 3 and is slidable radially outwardly or inwardly of the sprocket 3 as shown by the arrow a or b, respectively. The modified device does not have any slot 3*b* or guide pin 10*b* as shown in FIG. 10**.

Reference is now made to FIGS. 13, 14(A) to 14(G) and 15(A) to 15(F) showing the panel shutter assembly according to still another embodiment of this invention. The assembly includes a pair of cam mechanisms each associated with one of two arms 10 and constructed as shown at 11 in FIG. 9 and as hereinabove described. Each arm 10 has at its free end a stop surface 13 which is engageable with a long pin P to hold it at the rear end of the slot 51 through which it extends, as viewed in the direction of movement of the corresponding chain 5, when each panel is transferred from the panel supporting rails 4 to the sprockets 3 in the section B.

The stop surface 13 of each arm 10 extends arcuately so as to move-on the arc defined by it when the arm 10 is rotated about the shaft **3*a* for one of the sprockets 3. The stop surface 13 has a width W which is larger than that of the long pin P. The arm 10 has in its free end portion an engaging edge 14 which is engageable with the long pins P one after another when the panels are raised. The engaging edge 14 is formed as an arcuate surface which is contiguous to the stop surface 13** at an angle thereto.

Each link attachment 50 has a recessed slot portion **51*c* formed adjacent to the upper end of its slot 51 in the upright position of the link attachment 50 for receiving therein the long pin P which is pushed up along the slot 51 by the arm 10**.

Figure 13:
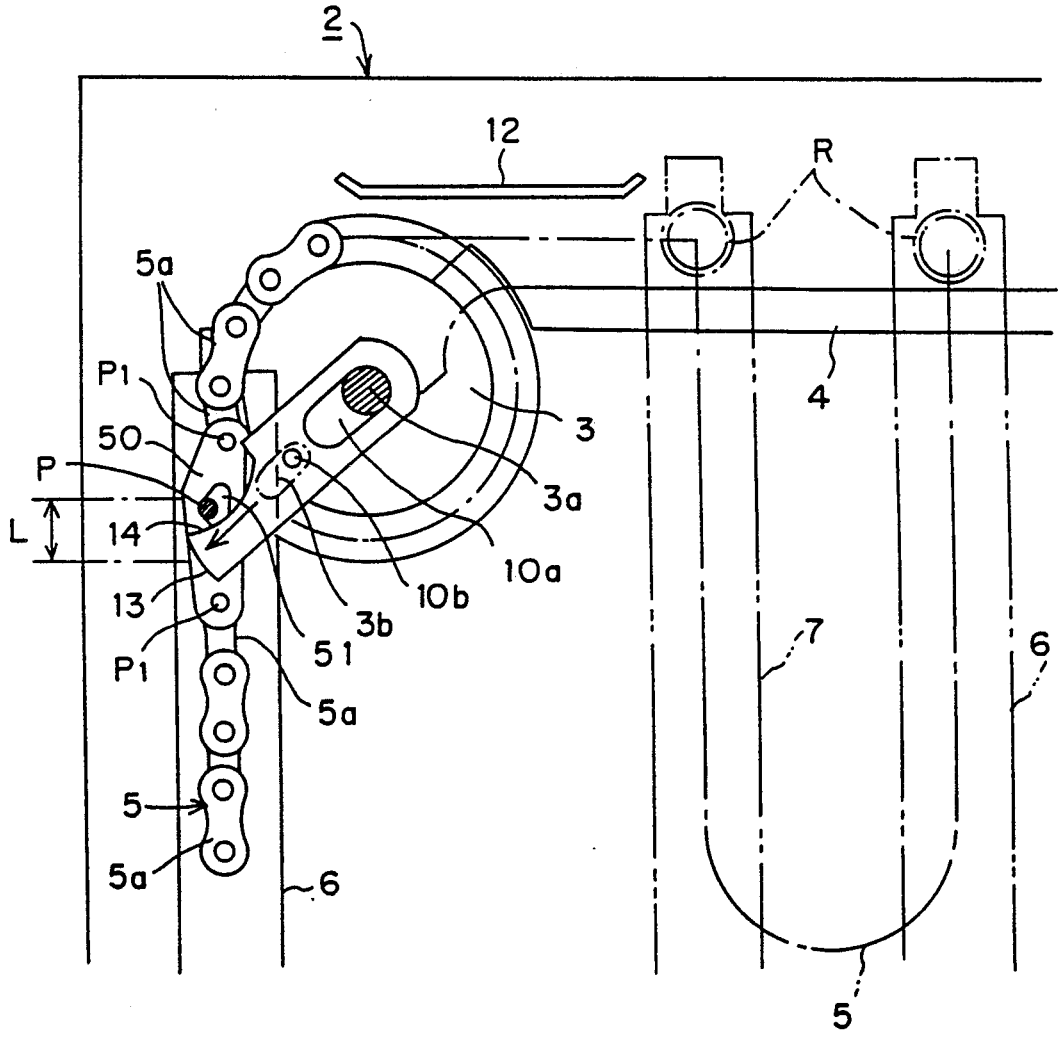
FIG. 13 is a fragmentary and schematic side elevational view, partly in section, of a panel shutter assembly according to still another embodiment of this invention.

The assembly also includes a pair of chain guide plates 12 each extending between the crest of one of the sprockets 3 and the adjacent end portion of one of the panel supporting rails 4, as shown in FIG. 13, for guiding the chain 5 for proper movement in either direction by preventing any undesirable bending of the chain 5 between the sprocket 3 and the panel supporting rail 4. The chain guide plates 12, therefore, ensure the smooth horizontal movement of each panel between the sprockets 3 and the panel supporting rails 4, and along the rails 4, even if the rails 4 may be horizontally disposed, and thereby enable a reduction in size of the panel housing 2.

If the sprockets 3 are rotated in one direction when the shutter is in its closed position in which the panels stay between the guide rails 1, the chains 5 are raised to raise the panels along the guide rails 1 one after another into the panel housing 2. As the link attachments 50 between which one panel 6 (FIG. 13) is supported approach the sprockets 3, the engaging edges 14 of the arms 10 rotating with the sprockets 3 and projecting to the greatest extent beyond the outer peripheries thereof engage the long pins P staying at the lower ends of the slots 51 and push up the long pins P along the slots 51, as shown in FIGS. 15(A) to 15(D). The upper panel 6 is, therefore, raised faster than the lower panel 7 not shown, and the projection 8 of the lower panel 7 is disengaged from the recess 9 of the upper panel 6.

Figure 15A:
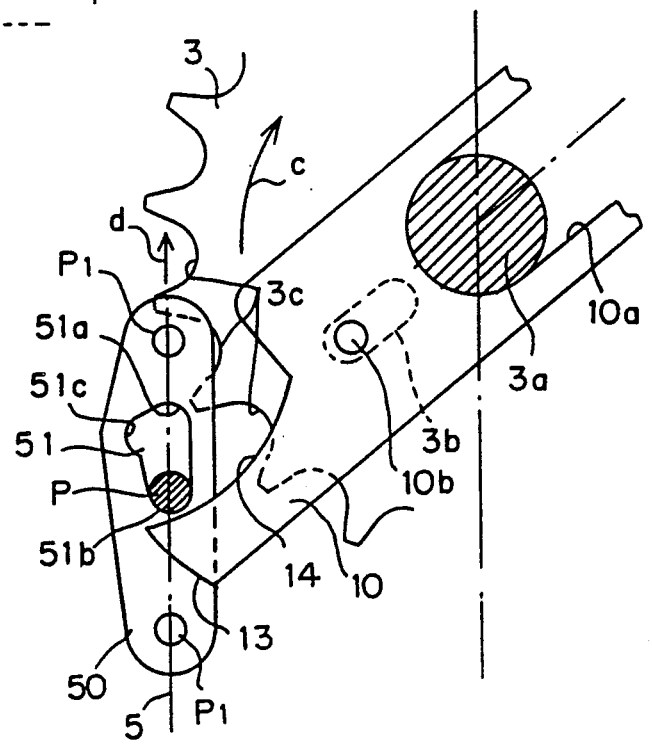
FIGS. 15(A) to 15(F) are a set of enlarged views similar to FIGS. 14(A) to 14(G), but showing an arm acting upon a long pin when each panel is raised.
Figure 15B:
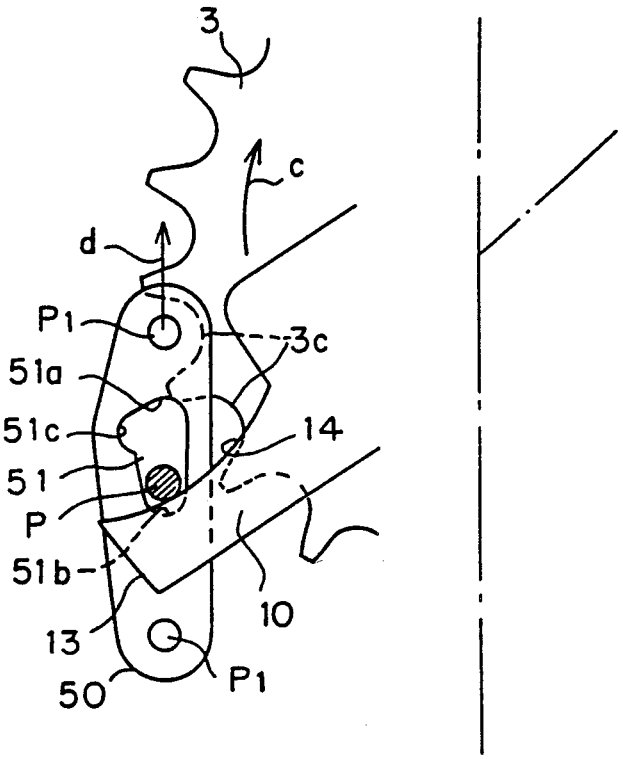
Figure 15C:
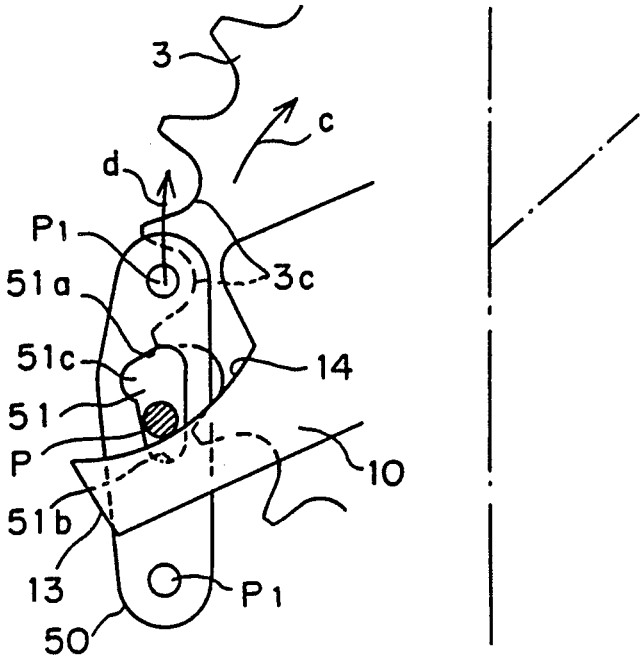
Figure 15:
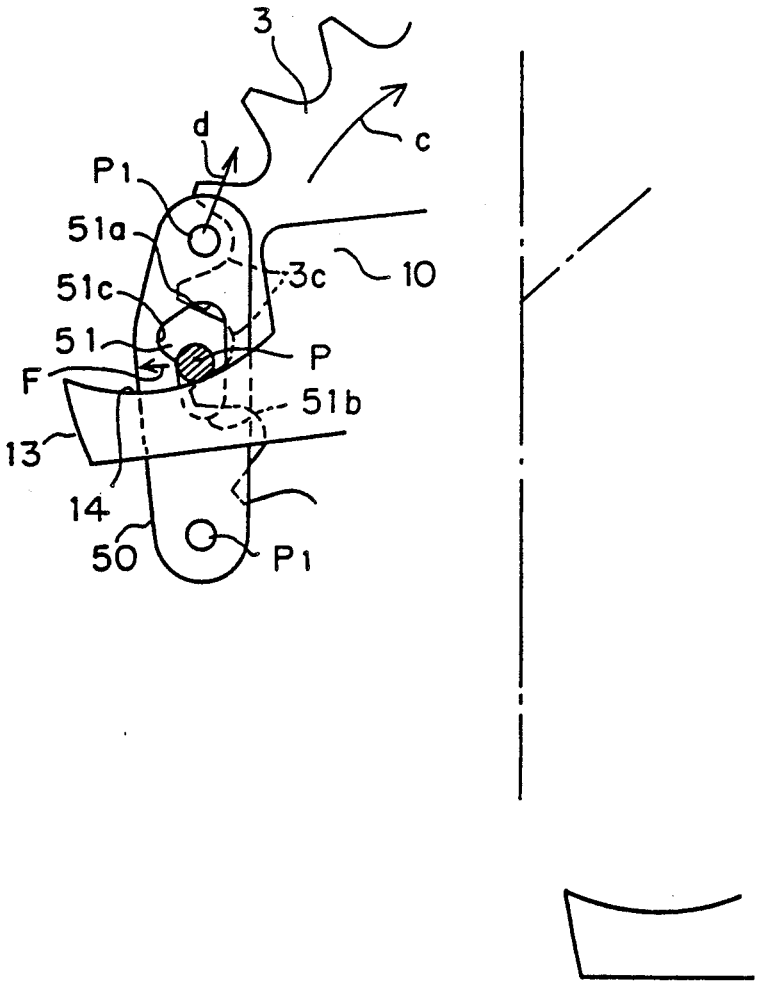
Figure 15E:
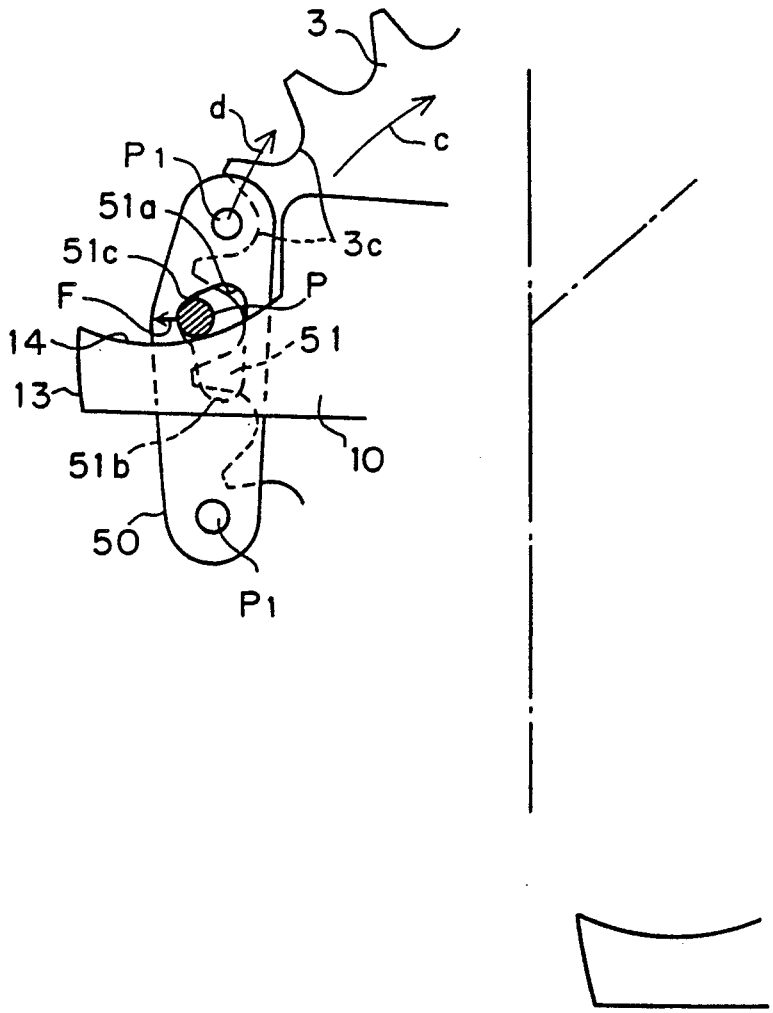

When the long pins P have been pushed up to the recessed slot portions 51c, they are moved into the recessed slot portions 51c by the engaging edges 14 of the arms 10, as shown in FIG. 15(E). The panel 6 is suspended from the long pins P held in the recessed slot portions 51c.

Figure 15F:
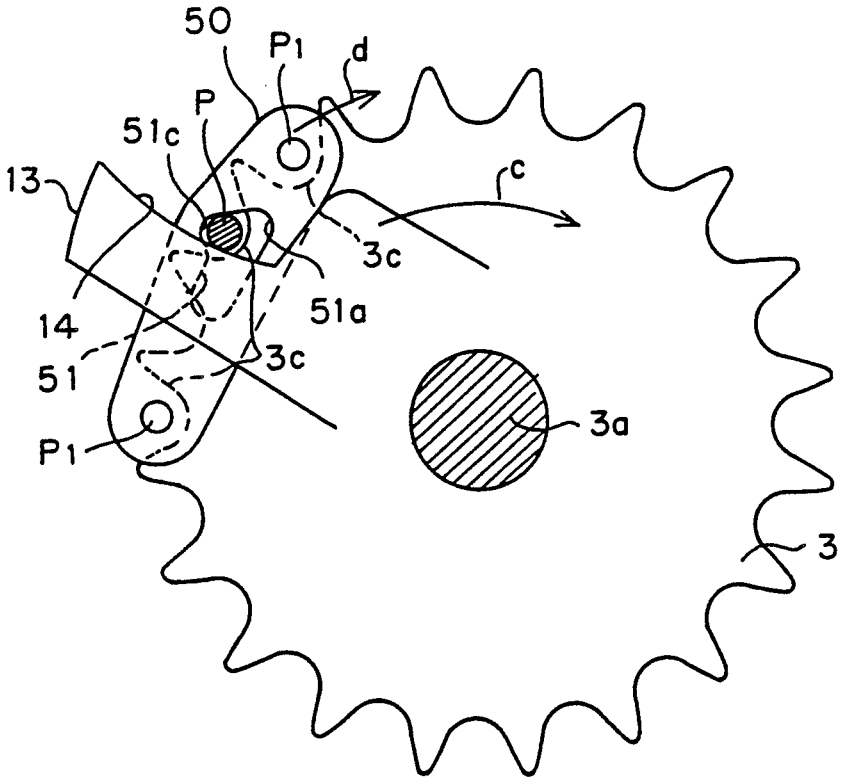
Figure 16:
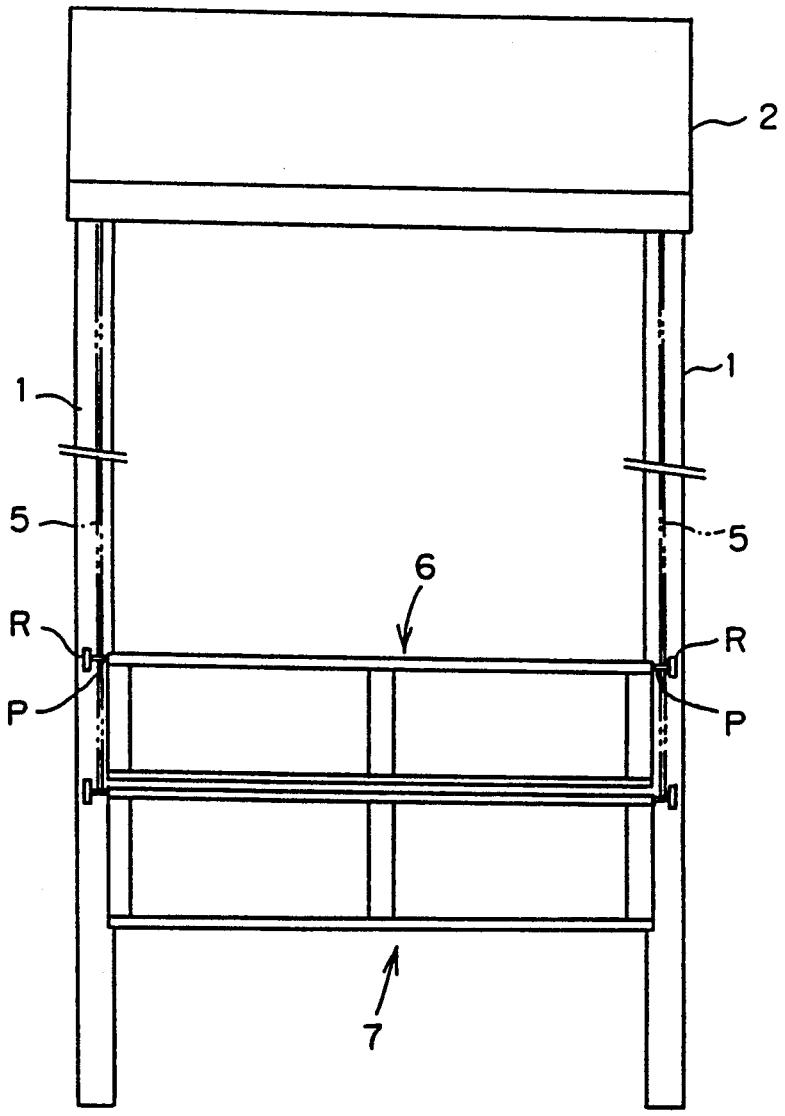
FIG. 16 (PRIOR ART)
FIG. 16 is a schematic front elevational view of a known panel shutter assembly.
Figure 17:
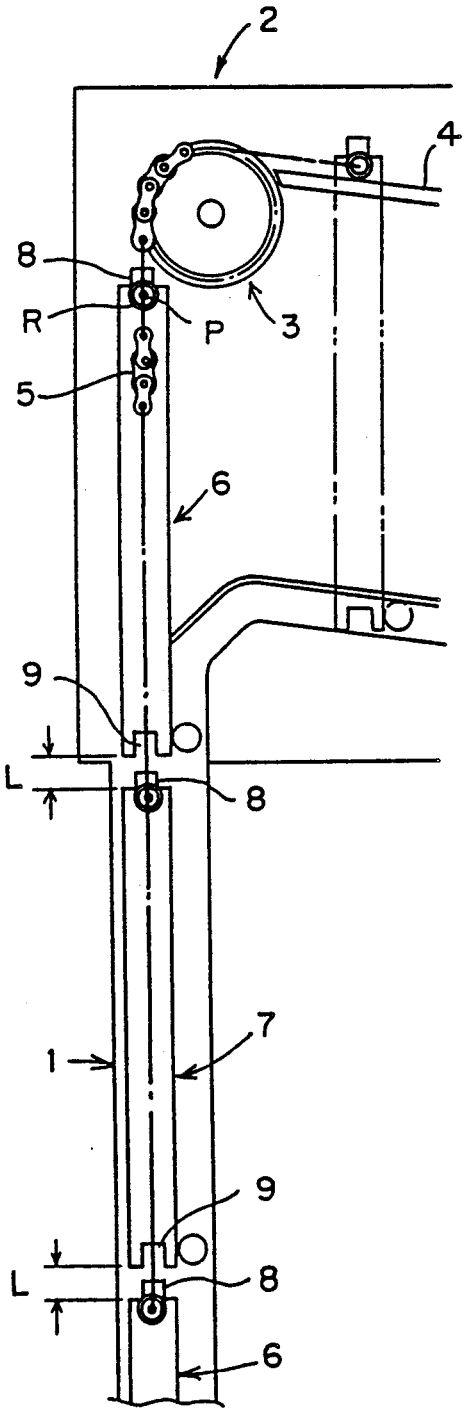
FIG. 17 (PRIOR ART)
FIG. 17 is an enlarged side elevational view, partly in section, of a part of the assembly shown in FIG. 16.
Figure 18:
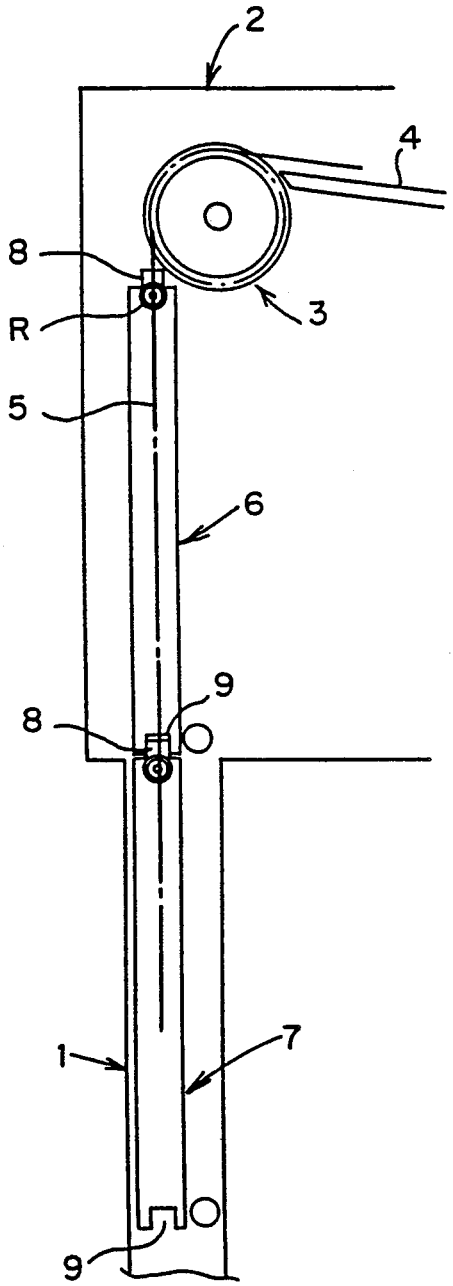
FIG. 18 (PRIOR ART)
FIG. 18 is a view similar to FIG. 17, and showing the problem which occurs to a couple of shutter panels being raised.
Figure 19:
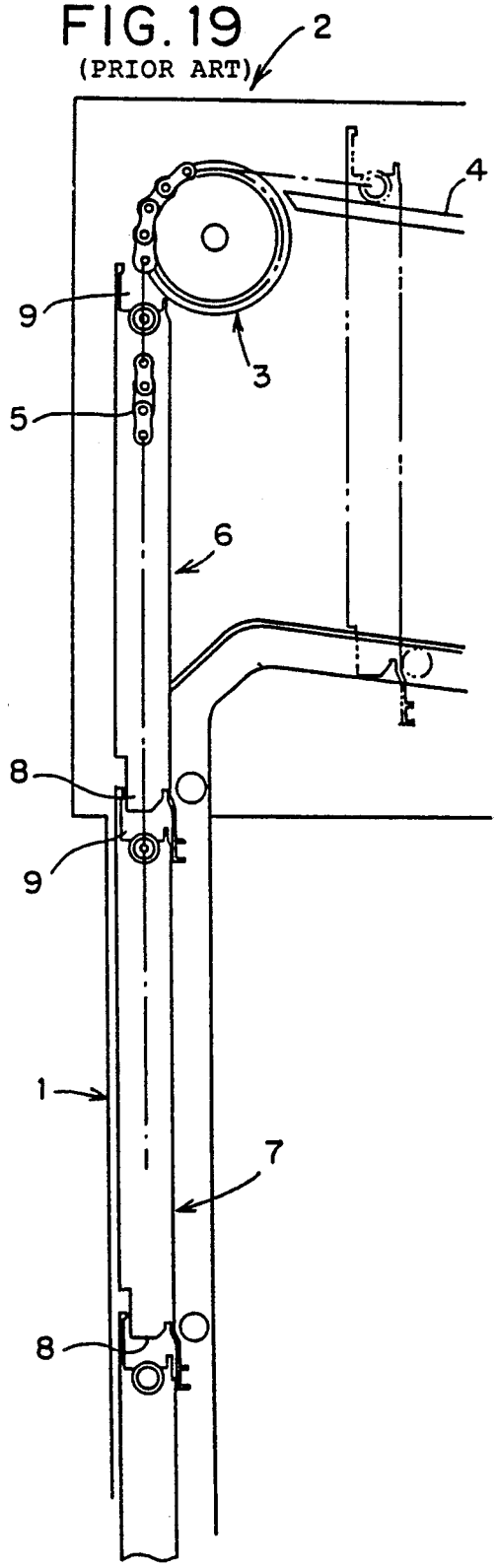
FIG. 19 (PRIOR ART)
FIG. 19 is a view similar to FIG. 17, but showing another known panel shutter assembly.

When the link attachments 50 have been further raised about the sprockets 3, the long pins P are brought into engagement with the teeth on the sprockets 3, as shown in FIG. 15(F). The link attachments 50 are further moved about the sprockets 3, and when they have been moved past the sprockets 3, the guide rollers R carried on the long pins P coaxially therewith ride on the panel supporting rails 4, whereupon the panel 6 is suspended from the rails 4. The operation is continued until all the panels are suspended from the rails 4 in parallel to one another.

If the sprockets 3 are rotated in the opposite direction when the shutter is in its open position, the chains 5 are lowered to pull the panels one after another from the panel supporting rails 4 to the sprockets 3 and lower them past the sprockets 3 to the opening between the guide rails 1.

Figure 14A:
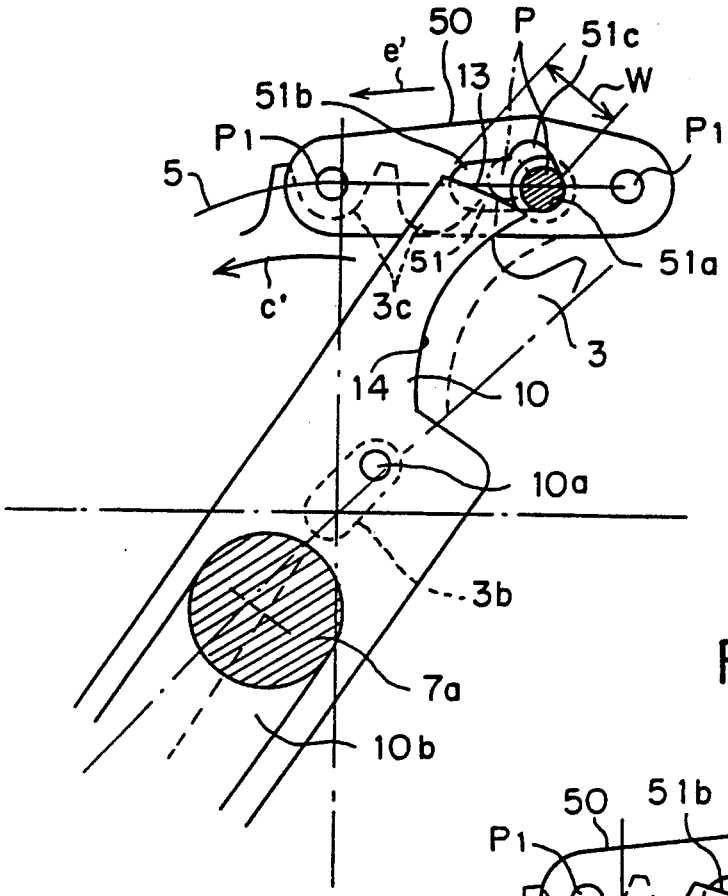
FIGS. 14(A) to 14(G) are a set of enlarged views of a part of the assembly shown in FIG. 13 which show an arm acting upon a long pin when each shutter panel is lowered.
Figure 14B:
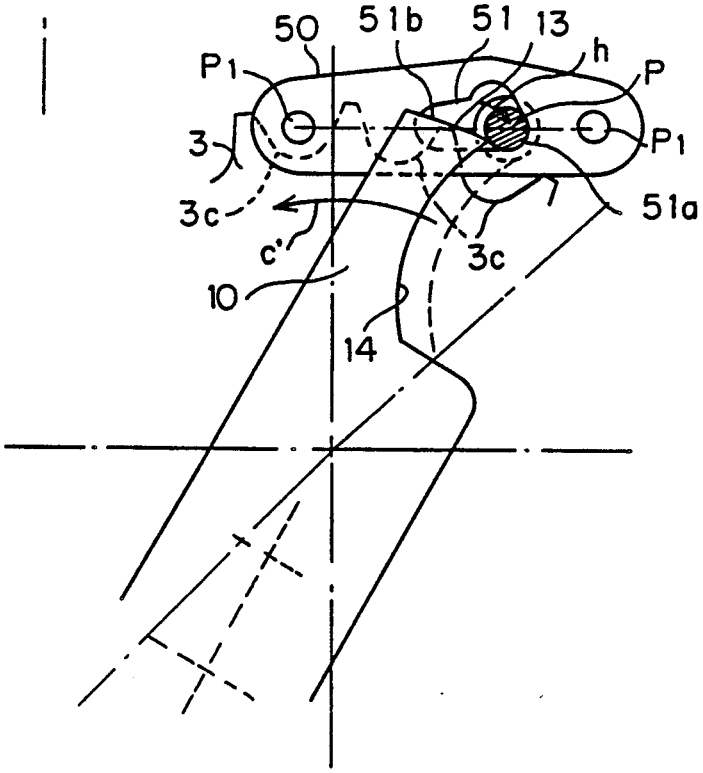
Figure 14C:
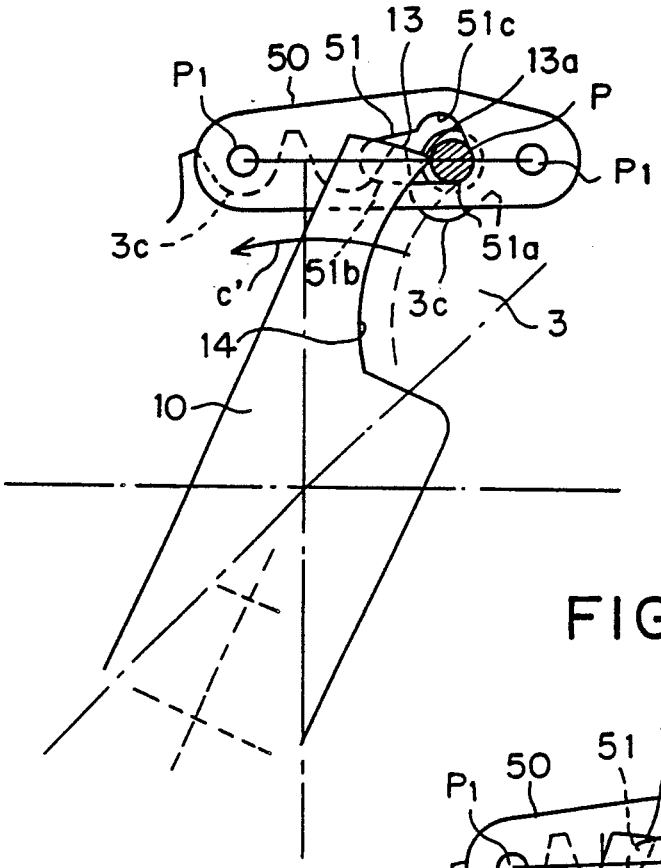
Figure 14D:
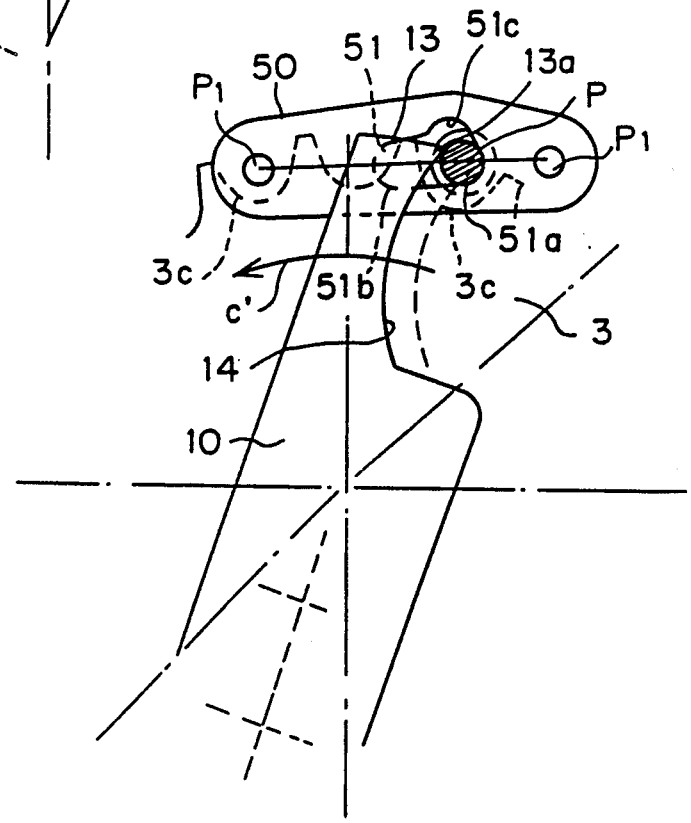
Figure 14E:
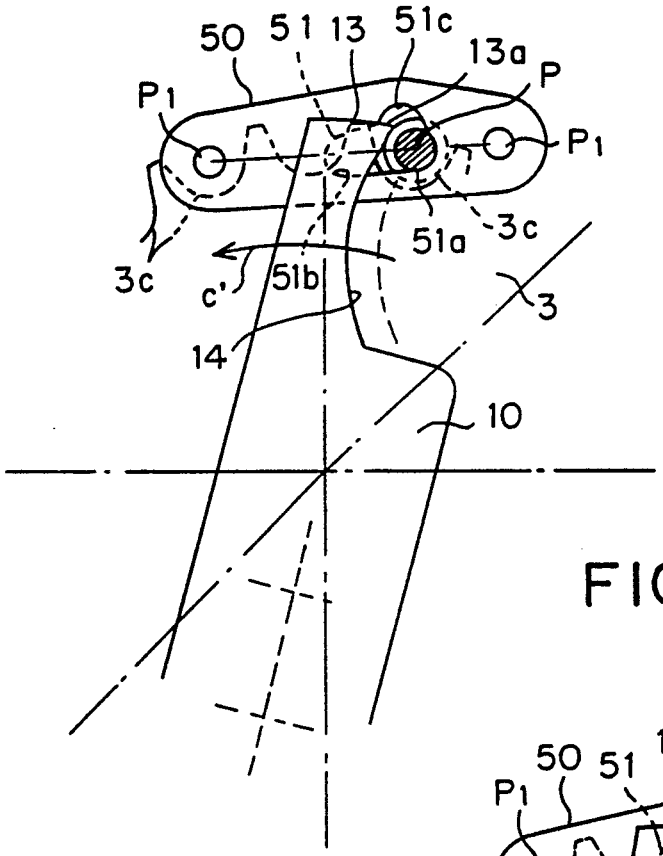
Figure 14F:
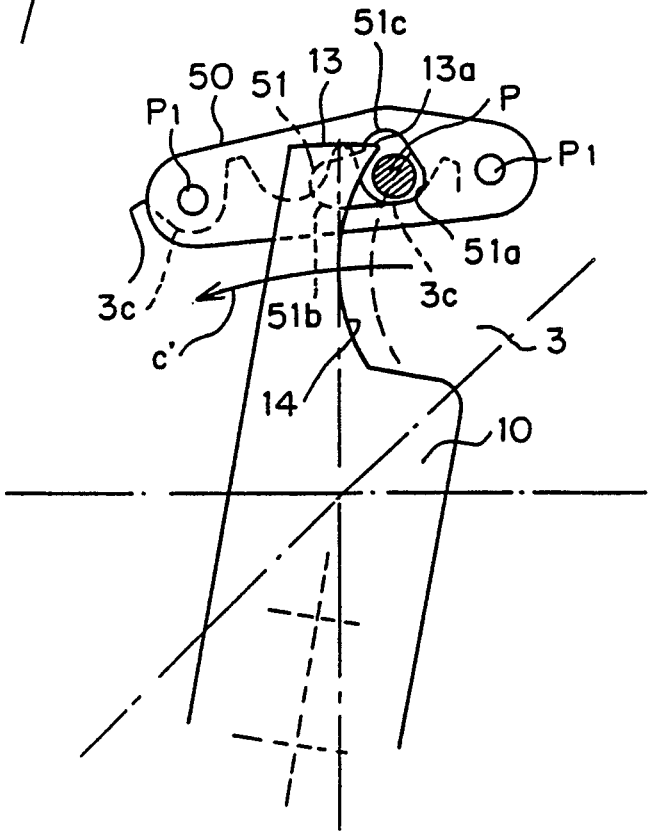
Figure 14G:
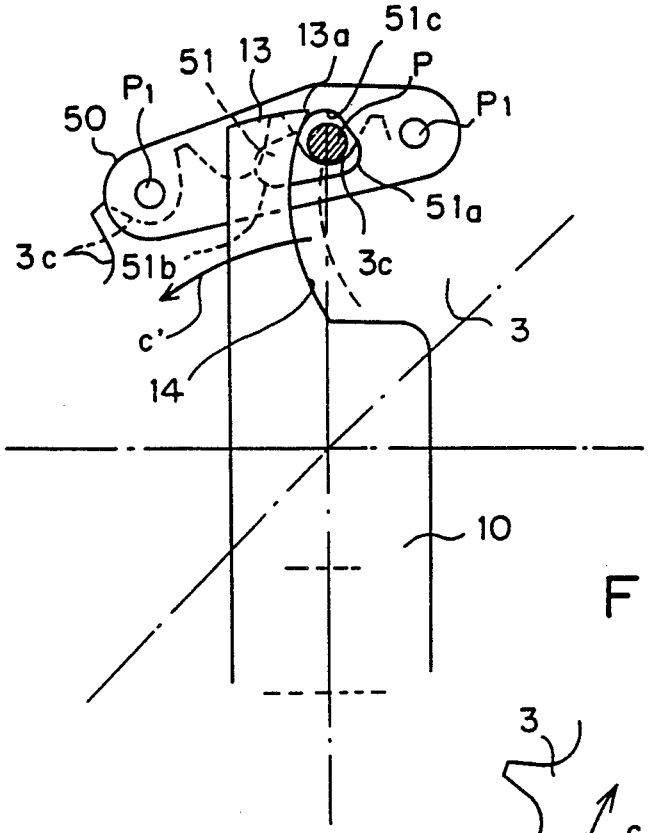

As the chains 5 are moved, the long pins P from which one panel is suspended approach the sprockets 3 to engage grooves 3c between teeth on the sprockets 3, and the stop surfaces 13 of the arms 10 engage the long pins P which might otherwise move toward the front ends of the slots 51, as viewed in the direction of chain movement, as a result of, for example, the vibration of the panel. As the sprockets 3 and the arms 10 are rotated in the direction of an arrow c', the long pins P slide down rearwardly in the direction of an arrow h along the arcuate stop surfaces 13 and are held against the rear ends 51a of the slots 51, as shown in FIG. 14(B), since the long pins P are urged down by the weight of the panel suspended therefrom.

As the sprockets 3 and the arms 10 are further rotated in the direction of the arrow c', the long pins P are held between the rear edges 13a of the stop surfaces 13 and the rear ends 51a of the slots 51, and are brought into proper engagement with the grooves 3c between teeth on the sprockets 3, as shown in FIGS. 14(C) to 14(G). When the link attachments 50 have been moved about the sprockets 3 to their upright positions, therefore, the long pins P are caused by the weight of the panel to drop by the height L (FIG. 13) from the rear or upper ends 51a of the slots 51 to the front or lower ends 51b thereof, and the recess 9 of the panel is brought into proper engagement with the projection 8 of the lower panel, if any.

Referring to FIG. 1 again, the assembly further includes a geared motor, or like driving means M for rotating the sprockets 3, a pair of lower guide rollers R1 supported rotatably on each panel 6 or 7 at the bottom thereof, while the guide rollers R carried on the long pins P from which each panel is suspended are now referred to as the upper guide rollers, and a pair of panel guide members 11 provided in the panel housing 2 near its bottom and extending in parallel to the panel supporting rails 4 for guiding the movement of the lower guide rollers R1 and thereby the movement of each panel in either direction.

The panel shutter assembly of this invention provides a number of outstanding advantages over any known apparatus, as is obvious from the foregoing description, and as will hereinafter be summarized. According to one aspect of this invention, the arms rotating with the sprockets have in their free end portions projecting from the outer peripheries of the sprockets a rotating speed which is higher than the peripheral velocity of the sprockets, and therefore, than the speed of the chains engaging the sprockets. When the panels are raised one after another into the panel housing, therefore, each panel raised into the panel housing and approaching the sprockets is raised faster than any other panel following it, and is thereby disengaged from the lower panel, so that it can smoothly be moved horizontally toward the panel supporting rails, while no gap is formed between any two adjoining panels staying between the guide rails. Therefore, there is no possibility of a finger, or anything else being caught between any two adjoining panels staying between the guide rails. Moreover, each panel is simple in construction and is low in height, as it is not required to have any overlapping member. The panel housing is, therefore, sufficiently small in height to reduce greatly any limitation to the place where the panel shutter can be installed.

According to another aspect of this invention, the long pins from which each panel is suspended are slidable along the slots of the link attachments through which they extend. This movement of the long pins ensures that a proper gap be formed between one panel raised into the panel housing and another panel following it to enable the preceding panel to be smoothly moved to the panel supporting rails, while no gap is formed between any two adjoining panels staying between the guide rails.

According to still another aspect of this invention, the long pins from which each panel is suspended are pushed up along the slots of the link attachments, and moved radially outwardly of the sprockets by the arms to be held in the recessed slot portions, so that the adjoining link pins of each chain may properly engage the teeth on the corresponding sprocket and thereby prevent any undesirable disengagement of the chain from the sprocket. When the panels are raised, therefore, it is unlikely that any unduly heavy load may bear on the arms and cause them or the cam mechanisms to break. It is also unlikely that any link pins of the chains may be pressed so strongly against any teeth on the sprockets that such link pins and teeth may be worn in an unduly short time. The assembly, therefore, has an improved degree of safety in operation and a prolonged life.

What is claimed is:

1. In an apparatus for driving a panel shutter including a plurality of shutter panels which are movable between a panel housing and an opening defined between a pair of upstanding guide rails depending from said housing, a pair of chains between which said panels are supported one after another, and a pair of sprockets supported rotatably in said housing and engaging said chains, respectively, to move said chains in either direction to move said panels, the improvement which comprises:

said chains each comprising a plurality of links including a plurality of spaced apart link attachments each having a longitudinally extending pin guide slot, each of said panels being suspended from a pair of long pins each having one end connected to said each panel, said each pin extending through said slot of one of said link attachments slidably along said slot; and a pair of arms each connected to a shaft on which one of said sprockets is rotatably supported, and having a free end portion projecting beyond the outer periphery of said one sprocket engageably with one of said pair of long pins, said each arm being rotatable with said one sprocket and having in said free end portion thereof a rotating speed which is higher than the peripheral velocity of said one sprocket, so that said long pins may be moved along said slots faster than said chains are moved about said sprockets, when said panels are each moved from said opening into said housing.

2. In a pair of chains for a panel shutter between which a plurality of shutter panels are supported one after another movably between a panel housing and an opening defined between a pair of upstanding guide rails depending from said housing, said chains engaging a pair of sprockets, respectively, which are rotatably supported in said housing to move said chains to move said panels, the improvement wherein each of said chains comprises a plurality of chain blocks each formed by a plurality of links connected flexibly to one another, and a plurality of link attachments each connected flexibly between one of said blocks and another, and having a longitudinally extending pin guide slot, each of said panels being suspended from a pair of long pins, one of said pins extending through said slot and being supported by said each link attachment slidably along said slot.

3. In a panel shutter assembly including a plurality of shutter panels which are movable between a panel housing and an opening defined between a pair of upstanding guide rails depending from said housing, a pair of chains between which said panels are supported one after another, a pair of sprockets supported rotatably in said housing and engaging said chains, respectively, to move said chains in either direction to move said panels, and a pair of panel supporting rails disposed substantially horizontally in said housing, said panels being movable between said opening and said panel supporting rails, the improvement which comprises:

a pair of arms supported rotatably with said sprockets, respectively, for engaging a pair of pins from which each of said panels approaching said sprockets is suspended, and pushing them up along the outer peripheries of said sprockets, when said each panel which has been moved from said opening is moved toward said rail supporting rails, said arms being movable radially of said sprockets; and a pair of cam mechanisms each associated with one of said arms for moving said one arm radially of one of said sprockets and thereby varying the radius of rotation of said one arm so as to maximize said radius when said pins are pushed up, and minimize it when said pins are transferred from the outer peripheries of said sprockets to said rail supporting rails.

4. In a panel shutter assembly including a plurality of shutter panels which are movable between a panel housing and an opening defined between a pair of upstanding guide rails depending from said housing, a pair of chains between which said panels are supported one after another, each of said panels being suspended from a pair of pins each supported by one of said chains, and a pair of sprockets supported rotatably in said housing and engaging said chains, respectively, to move said chains and thereby said panels in either direction, the improvement which comprises:

said chains each comprising a plurality of links including a plurality of link attachments which are greater in length than the rest of said links, each of said link attachments having a longitudinally extending pin guide slot through which one of said pins extends slidably along said slot; and a pair of arms each connected to the shaft on which one of said sprockets is rotatably supported, said each arm being rotatable with said one sprocket and slidable radially of said one sprocket to have a portion project beyond the outer periphery of said one sprocket and engage one of said pins, said portion of said each arm terminating in a stop surface which is engageable with one of said pins to hold said one pin at the rear end of said slot through which said one pin extends, when said each panel is moved to said sprockets for further movement toward said opening.

5. A panel shutter assembly as set forth in claim 4, wherein said each arm has in said portion thereof an edge which is engageable with said one pin to displace it away from the teeth of said one sprocket when said each panel has reached said sprockets for further movement away from said opening, and said slot has a recessed portion for receiving said displaced pin therein.

* * * * *

UNITED STATES PATENT AND TRADEMARK OFFICE

CERTIFICATE OF CORRECTION

PATENT NO. : 5,065,806

DATED : November 19, 1991

INVENTOR(S) : Kohichi Kondoh

It is certified that error appears in the above-identified patent and that said Letters Patent is hereby corrected as shown below:

Column 6, line 49, "line" should be --link--;
lines 54-56, delete "Each long pin P extends through the slot 51 of one of the link attachments to its top edge, as shown in FIG. 2."

Column 7, line 48, after "open" delete the hyphen and comma "-,";
line 53, after "open" delete the comma ",".

Signed and Sealed this

Thirty-first Day of August, 1993

*Attest:*

*Attesting Officer*

Bruce Lehman

BRUCE LEHMAN

*Commissioner of Patents and Trademarks*